US012611023B2

(12) United States Patent
Smith et al.

(10) Patent No.: US 12,611,023 B2
(45) Date of Patent: Apr. 28, 2026

(54) DEVICE WITH ADHESIVE TO AID IN DEPILATORY WAX REMOVAL

(71) Applicant: Flipcat LLC, Blossom, TX (US)

(72) Inventors: Catherine Smith, Blossom, TX (US); Jessica Elizabeth Smith, New Port Richey, FL (US)

(73) Assignee: Flipcat LLC, Blossom, TX (US)

( * ) Notice: Subject to any disclaimer, the term of this patent is extended or adjusted under 35 U.S.C. 154(b) by 18 days.

(21) Appl. No.: 18/770,557

(22) Filed: Jul. 11, 2024

(65) Prior Publication Data

US 2026/0013618 A1 Jan. 15, 2026

(51) Int. Cl.
*A45D 26/00* (2006.01)

(52) U.S. Cl.
CPC ..... *A45D 26/0019* (2013.01); *A45D 26/0014* (2013.01)

(58) Field of Classification Search
CPC ..... A45D 26/0014; A45D 26/0019
See application file for complete search history.

(56) References Cited

U.S. PATENT DOCUMENTS

2011/0257662 A1* 10/2011 Pfau ..... A45D 26/0014 132/200
2015/0374091 A1* 12/2015 Ismiel-Nash ..... A61Q 9/04 606/134
2020/0405032 A1* 12/2020 Stack ..... A45D 26/0019

* cited by examiner

*Primary Examiner* — Todd J Scherbel

(57) ABSTRACT

The present invention is directed to a device comprising a fabric substrate layer having a dividing line horizontal to the length of the fabric substrate layer that divides a first part coated with a skin-safe adhesive layer on one side and a second part that is not covered by the skin-safe adhesive layer; and methods of application therefrom.

4 Claims, 3 Drawing Sheets

FIG. 1A-B
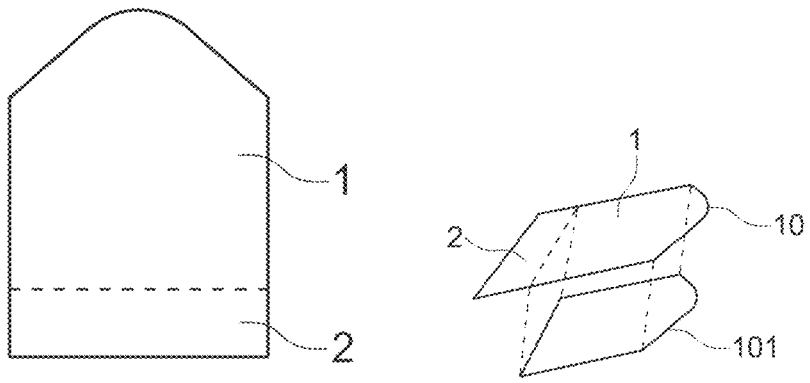
1A 1B
FIG. 2
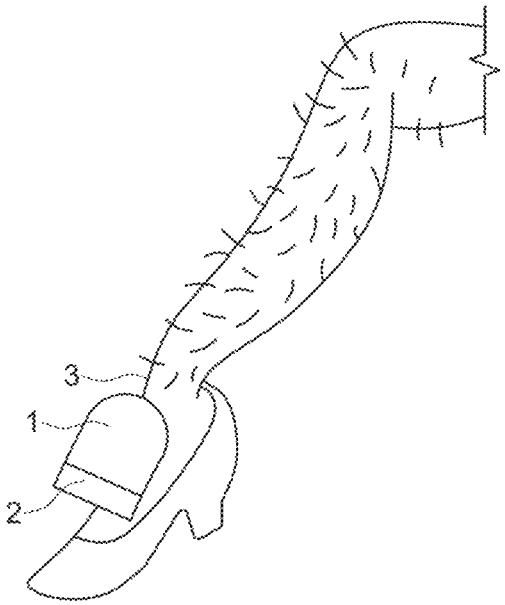

DEVICE WITH ADHESIVE TO AID IN DEPILATORY WAX REMOVAL

BACKGROUND OF THE INVENTION

Hard depilatory wax is a type of wax used in hair removal. Waxing with hard wax uses a melted wax beads applied in a thin layer to the skin. Once the wax hardens and cools, it is quickly ripped off in the opposite direction of hair growth, removing the hairs along with it.

SUMMARY OF THE INVENTION

In one aspect provides a device comprising a fabric substrate layer having a dividing line horizontal to the length of the fabric substrate layer that divides a first part coated with a skin-safe adhesive layer on one side and a second part that is not covered by the skin-safe adhesive layer.

In another aspect provides a method of removing body part hairs, comprising: applying the device disclosed herein onto a body part with the skin-safe adhesive layer side facing down from a lowest point of where a wax strip will be applied; then applying hard wax to cover at least a portion of the first part of the fabric substrate layer; grasping a portion of the first part without adhesive and pulling the device along with the wax strip away from the body part to remove the wax strip with body part hairs.

In yet another aspect provides a method of removing a depilatory wax (e.g., a hard wax) on a skin, comprising: applying the device disclosed herein onto a body part with the skin-safe adhesive layer side facing down from a lowest point of where the depilatory wax strip is applied which covers at least a portion of the first part of the fabric substrate layer opposite of the skin-safe adhesive layer; grasping a portion of the first part and pulling the device along with the wax strip away from the body part to remove the depilatory wax strip.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

FIG. 1A/B illustrate the invention device in different views. FIG. 1A shows a top view of the device with the first part 1 and second part 2. FIG. 1B show a perspective view of the device with a fabric substrate layer 10 and a skin-safe adhesive layer 101.

FIG. 2 illustrates step 1 of a method to remove body hairs by applying an exemplary invention device to aid removing depilatory wax.

DETAILED DESCRIPTION OF THE INVENTION

Figure 3:
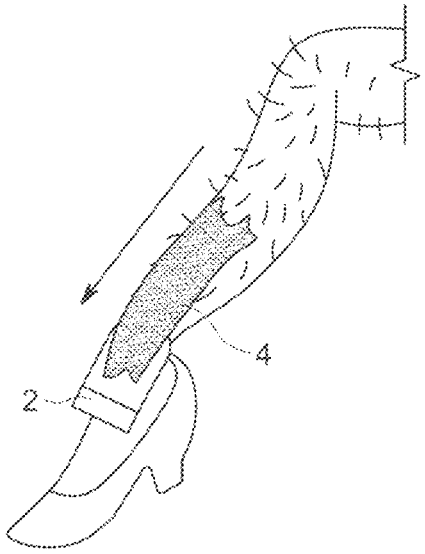
FIG. 3 illustrates step 2 of a method to remove body hairs by applying an exemplary invention device to aid removing depilatory wax.

Although there are a couple ways to tackle hard depilatory wax left on your skin, such as using oil, petroleum jelly, or a warm washcloth, it is not that easy for a beginner waxer to remove hard wax strips like a professional without having to learn how to lay a strip correctly and creating a lip at the end of the hard wax strip.

During the process of removing unwanted hair by waxing, wax is applied to the area in the direction of hair growth. When the wax cools, one needs to hold the skin taut, and quickly remove the hardened wax in the opposite direction of hair growth. Waxing yourself can be a cost-effective option, but achieving professional-like results takes dedication and practice. Professionals develop and practice the correct way to create a lip at the end of a wax strip for easy removal. Because this technique is taught professionally and takes hours of practice and oversight to perfect, it can be a significant challenge for at-home or non-professional waxers to achieve the same results. Thus, it presents a challenge for a beginner waxer.

The present invention provides a device to replace the need to create a lip on a wax strip, especially a hard wax strip. This device has one half of the bottom part coated with an adhesive on one side to aid in depilatory wax removal. The other is not coated and is plain fabric substrate material so it can be grasped with the fingers to remove wax more easily.

In some embodiments provide a device (e.g., a depilatory wax pull tab) comprising a fabric substrate layer having a width and a length to be suitable adhered to certain spaces on the body wherein at least a portion of the fabric substrate layer is coated with a skin-safe adhesive on one side. In some embodiments, the fabric substrate is particularly susceptible to accept a wax applying on the other side of the skin-safe adhesive coated side.

Exemplary Designs

An exemplary invention device (e.g., a depilatory wax pull tab) is illustrated in FIG. 1A/B. In some embodiments provide a device comprising a fabric substrate layer (10) coated with a skin-safe adhesive layer on one side (101) wherein the fabric substrate layer has a dividing line horizontal to the length of the fabric substrate layer dividing a part (i.e., a first part) coated with a skin-safe adhesive layer on one side and a pull tab (i.e., a second part, 2) that is not covered by the skin-safe adhesive layer.

The main layer of the device, a fabric substrate layer having a width and a length to be suitably adhered to an area of a body part, in some embodiments, is made of a biodegradable fabric substrate such as a paper, a cloth, a plastic material, or the like. In certain embodiments, the fabric substrate is a biodegradable paper. For example, a paper tab has a width and a length to be suitably adhered to certain spaces on the body. The device may be in variable sizes applicable to the body part not limited to a particular shape. For example, a smaller size in 1 inch by 2 inches and a larger size in 2 inches by 3 inches. In some embodiments, the device is in size of 1 inch by 1 inch, 1 inch by 2 inches, 1 inch by 3 inches, or 1 inch by 4 inches. In some embodiments, the device is in size of 2 inches by 1 inch, 2 inches by 2 inches, 2 inches by 3 inches, or 2 inches by 4 inches. In some embodiments, the device is in size of 3 inches by 1 inch, 3 inches by 2 inches, 3 inches by 3 inches, or 3 inches by 4 inches. In some embodiments, the device is in size of 4 inches by 1 inch, 4 inches by 2 inches, 4 inches by 3 inches, or 4 inches by 4 inches.

FIG. 1A illustrates the basic design of the invention device showing the top view of the device where a first part (1) and a second part (2) of the substrate layer is shown. The shape of the device in the provided figures is for illustration purpose, which may be in any shape as long as there are two parts in accordance with the disclosed embodiments. FIG. 1B further illustrates a perspective view of the device showing a skin-safe adhesive layer (101) that will be applied to one side of the fabric substrate layer 10. In some embodiments, the device further comprises an adhesive layer cover to cover the skin-safe adhesive layer. In certain embodiments, the adhesive layer cover is made of a plastic film.

For example, the device may be a paper strip having a dividing line that is horizontal to the length of the tab that divides the half covered in a skin-safe adhesive (i.e., the first part). The other half (i.e., the second part) is without adhesive so it can be gripped for wax removal.

In some embodiments, the fabric substrate layer has a dividing line horizontal to the length of the layer that divides one-half (½) to three quarters (¾) area of the substrate layer (i.e., the first part) with a skin-safe adhesive coated on one side of the layer by the skin-safe adhesive layer. In certain embodiments, the fabric substrate layer has a dividing line horizontal to the length of the layer that divides one-half (½) area of the substrate layer with a skin-safe adhesive coated on one side of the layer by the skin-safe adhesive layer.

The device (e.g., a paper strip) serves as a way for beginners to remove hard wax strips like a professional without having to learn how to lay the lip of a hard wax strip. In some embodiments, the fabric substrate is made from biodegradable paper with skin-safe adhesive, this allows users to move wax more easily from different parts of the body.

The invention device has the following benefits and advantages:

- Environmentally sustainable: the main fabric substrate layer e.g., a paper, will be biodegradable.
- Skin-safe: adhesive will be non-irritating and safe for skin.
- Unique: The application and design of the device will make waxing easier for at-home users.
- As such, the invention device (e.g., a wax pull tab with skin-safe adhesive on half of the tab) represents a significant advancement in the field depilatory wax hair removal. Its innovative design and environmentally sustainable features offer users a convenient and easier way to wax at-home.

Examples of suitable fabric substrates for the invention device include, but are not limited to a cloth, a paper, a plastic material, or the like, which are biodegradable.

In certain embodiments, the fabric substrate layer is made of a biodegradable paper.

Examples of suitable skin-safe adhesives for the invention device include, but are not limited to a silicone adhesive, acrylic adhesive, or any other suitable skin-safe adhesives such as a naturally derived adhesive.

Applications of Exemplary Devices to Aid in Removing Depilatory Wax

Step 1: Apply the invention device onto the body part (e.g., a skin part with hairs) with the adhesive side facing to the skin from the lowest point (3) of where the wax strip will be applied in the direction of hair growth as shown in FIG. 2.

Step 2: Apply hard wax 4 according to normal instructions in the direction of hair growth but make sure to cover at least area of the device but not cover the first part 1 (e.g., the second part 2 of the fabric substrate opposite side of the skin-safe adhesive layer) with wax as shown in FIG. 3. In some embodiments, the wax applies to at least ¼, ⅓, or ½ of the fabric substrate. In certain embodiments, the wax applies to the whole area of the fabric substrate opposite side of the second part 2.

Figure 4:
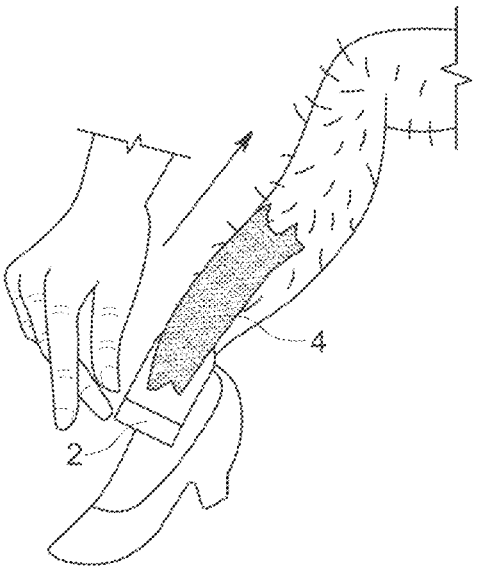
FIG. 4 illustrates step 3 of a method to remove body hairs by applying an exemplary invention device to aid removing depilatory wax.

Step 3: Grasp a portion of the first part 1 (e.g., the end of the paper tab) and start pulling the device along with the wax strip 4 in the opposite direction of hair growth as shown in FIG. 4.

Figure 5:
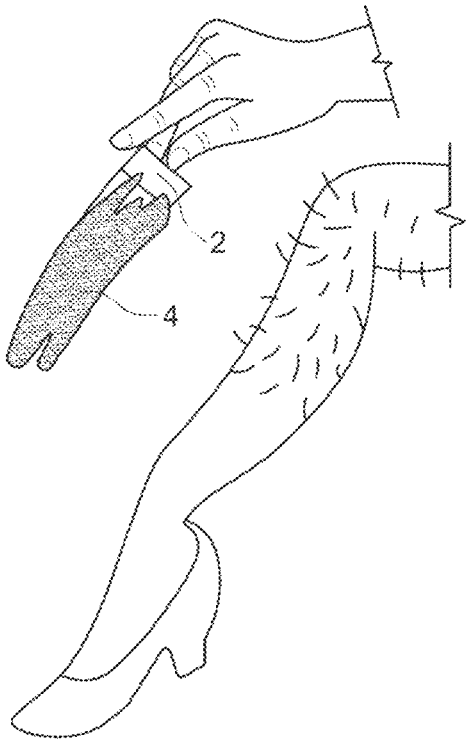
FIG. 5 illustrates step 4 of a method to remove body hairs by applying an exemplary invention device to aid removing depilatory wax.

Step 4: Grasp the portion of the first part 1 (e.g., the end of the paper tab) and pull wax strip 4 in the opposite direction of hair growth to remove the wax strip with body hairs as shown in FIG. 5.

In some embodiments provide a method of removing a depilatory wax on a skin, comprising: applying the device of claim 1 onto a body part with the skin-safe adhesive layer side facing down from a lowest point of where the depilatory wax strip is applied which covers at least a portion of the first part of the fabric substrate layer opposite of the skin-safe adhesive layer; grasping a portion of the first part and pulling the device along with the wax strip away from the body part to remove the depilatory wax strip.

In other embodiments provide a method of removing a depilatory wax (e.g., a hard wax) on a skin, comprising: applying the device disclosed herein onto a body part with the skin-safe adhesive layer side facing down from a lowest point of where the depilatory wax strip is applied which covers at least a portion of the first part of the fabric substrate layer opposite of the skin-safe adhesive layer; grasping a portion of the first part and pulling the device along with the wax strip away from the body part to remove the depilatory wax strip.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A method of removing a depilatory wax on a skin, comprising: applying a device comprising a fabric substrate layer having a dividing line horizontal to the length of the fabric substrate layer that divides a first part coated with a skin-safe adhesive layer on one side and a second part that is not covered by the skin-safe adhesive layer, onto a body part with the skin-safe adhesive layer side facing down from a lowest point of where a depilatory wax strip is applied which covers at least a portion of the first part of the fabric substrate layer opposite of the skin-safe adhesive layer; grasping a portion of the first part and pulling the device along with the wax strip away from the body part to remove the depilatory wax.

2. The method of claim 1, wherein the device is in size of 1 inch by 2 inches, or 2 inches by 3 inches.

3. The method of claim 1, wherein the dividing line divides one-half (½) to three quarters (¾) area of the substrate layer coated with the skin-safe adhesive layer.

4. The method of claim 1, wherein the fabric substrate layer is a paper.

* * * * *